US007770617B2

(12) United States Patent
Broemsen et al.

(10) Patent No.: US 7,770,617 B2
(45) Date of Patent: Aug. 10, 2010

(54) SAFETY WORKBENCH HAVING DOUBLE-WALLED FLOOR TROUGH

(75) Inventors: Olaf Broemsen, Moerfelden (DE); Edmund Frickel, Gruendau (DE); Christoph Noll, Gruendau (DE)

(73) Assignee: Thermo Electron LED GmbH (DE)

( * ) Notice: Subject to any disclaimer, the term of this patent is extended or adjusted under 35 U.S.C. 154(b) by 231 days.

(21) Appl. No.: 11/958,158

(22) Filed: Dec. 17, 2007

(65) Prior Publication Data

US 2008/0150405 A1 Jun. 26, 2008

(30) Foreign Application Priority Data

Dec. 21, 2006 (DE) ..... 10 2006 060 712

(51) Int. Cl.
*B25H 1/00* (2006.01)

(52) U.S. Cl. ..... 144/286.5; 144/285

(58) Field of Classification Search ..... 144/285, 144/286.1, 286.5, 287; 108/33; 312/209
See application file for complete search history.

(56) References Cited

U.S. PATENT DOCUMENTS

| | | | | |
|---|---|---|---|---|
| 4,408,642 | A * | 10/1983 | Jeruzal et al. | 144/286.5 |
| 5,582,225 | A * | 12/1996 | Schank | 144/286.1 |
| 6,557,602 | B1 * | 5/2003 | Sorensen et al. | 144/286.5 |
| 6,823,907 | B2 * | 11/2004 | Cheng | 144/286.1 |
| 6,966,350 | B1 * | 11/2005 | Gist | 144/285 |
| 7,006,876 | B2 | 2/2006 | Ross | |
| 2003/0222087 | A1 | 12/2003 | Frickel | |

FOREIGN PATENT DOCUMENTS

| | | | |
|---|---|---|---|
| DE | 44 41 784 | A1 | 5/1996 |
| DE | 297 23 636 | U1 | 1/1999 |
| DE | 100 17 196 | A1 | 10/2001 |
| DE | 102 14 158 | A1 | 10/2003 |
| DE | 102 17 903 | C1 | 10/2003 |
| DE | 10214158 | A1 | 10/2003 |
| DE | 10 2004 032 454 | A1 | 1/2006 |
| DE | 102004032454 | A1 | 1/2006 |
| EP | 1348497 | A2 * | 10/2003 |
| NL | 6601730 | | 8/1967 |

OTHER PUBLICATIONS

European Search Report dated Mar. 5, 2008, pp. 2.

* cited by examiner

*Primary Examiner*—Shelley Self
(74) *Attorney, Agent, or Firm*—Wood, Herron & Evans, LLP

(57) ABSTRACT

The present invention relates to a safety workbench having a working inner chamber enclosed by a housing, whose bottom terminus is formed by a floor trough and which is accessible on a housing front side via a work opening closable using an adjustable front pane. The floor trough is implemented as double-walled and has an internal and an external wall, which enclose an intermediate chamber, which may be placed under vacuum, between them, at least one of the walls having at least one opening which is connected to means for generating the partial vacuum.

8 Claims, 3 Drawing Sheets

SAFETY WORKBENCH HAVING DOUBLE-WALLED FLOOR TROUGH

CROSS-REFERENCE TO RELATED APPLICATIONS

This application claims priority of German patent application no. 10 2006 060 712.0, filed Dec. 21, 2006, the disclosure of which is incorporated herein by reference in its entirety.

FIELD OF THE INVENTION

The present invention relates to a safety workbench having a working inner chamber enclosed by a housing, whose lower terminus is formed by a floor trough and which is accessible on a housing front side via a work opening closable using an adjustable front pane.

BACKGROUND OF THE INVENTION

Safety workbenches fulfill various functions. They are used above all for protecting the operator from direct exposure to infectious aerosols, protecting the immediate laboratory surroundings from a contamination by released aerosols (environmental and personal protection), and protecting the product and the materials used from contamination by microorganisms from the surroundings.

The basic construction of safety workbenches comprises an inner chamber enclosed by a housing, which has a work opening on the housing front side, which is closable by a transparent front pane which is adjustable upward and/or downward. The inner chamber is also identified in the meaning of the present invention as a working chamber or a working inner chamber. Such safety workbenches are already known in greatly varying embodiments from the prior art, for example, from DE 44 41 784 A1, DE 102 17 903 C1, DE 297 23 636 U1, and DE 100 17 196 A1.

Furthermore, safety workbenches have a floor trough in the lower section of the working chamber. Floor troughs of this type terminate the working chamber on the bottom with a seal, capture substances seeping through the work plate, and are to prevent the substances from unintentionally escaping to the outside and contaminating the surroundings of the safety workbench. A floor trough of the prior art is described, for example, in DE 102 14 158 A1. The floor trough is shaped from a one-piece metal sheet and is accordingly single-walled.

For the safety workbenches, it is important above all that harmful substances or bacteria from the inner chamber of the workbench do not reach the room where it is installed under any circumstances. Protecting the operators and the environment is in the foreground. Safety workbenches in laboratories, in particular those which are suitable for microbiological work, therefore have to meet strict safety requirements. They have fans which generate directed air flows and guide these air flows via special filters, to remove particles or aerosols entrained in the air and not permit them to reach the operator or outside the safety workbench. Such a safety workbench is described, for example, in DE 10 2004 032 454 A1.

So-called personal protection in safety workbenches is achieved by suctioning outside air through the work opening into the working chamber of the safety workbench. As long as this external air flow is not obstructed and sufficient air is suctioned in, particles and aerosols may not reach the outside from the inner chamber of the safety workbench. The suctioned external air thus forms an air curtain flowing through the work opening, which protects the person working at the safety workbench and/or the environment from contamination by the particles. A pressure reduced in relation to the pressure in the surroundings of the safety workbench exists inside the working inner chamber of the safety workbench due to the flow guiding, which is also referred to as a partial vacuum in the following. The partial vacuum ends at the surface of the floor trough, which forms the lower terminus of the working inner chamber, facing toward the working chamber.

To ensure that no leaks arise in the area of the floor trough, corresponding model testing is typically absolutely required for the licensing of the safety workbench. However, this does not preclude that leaks will occur in the area of the floor trough in the course of use, which are possibly no longer recognized. This may represent a significant hazard to the operating personnel and the environment.

SUMMARY OF THE INVENTION

The object of the present invention is therefore to provide a safety workbench in which the risk of occurrence of contamination through a damaged floor trough in the surroundings of the safety workbench is significantly reduced in relation to the prior art and is entirely precluded as much as possible.

This object is achieved by the safety workbench according to Claim 1. Further embodiments are described in the subclaims.

The present invention accordingly relates to safety workbench having a working inner chamber enclosed by a housing, whose bottom terminus is formed by a floor trough and which is accessible on a housing front side via a work opening closable using an adjustable front pane. The floor trough is implemented as double-walled according to the present invention and has an internal wall and an external wall, which enclose an intermediate chamber, which may be placed under partial vacuum, between them, at least one of the walls having at least one opening which is connected to means for generating the partial vacuum.

For the prevention of leaks in the area of the floor trough, it has been proven to be an advantage in relation to the prior art in the implementation according to the present invention that the double-walled implementation offers doubled safety in relation to the single-walled floor trough, because two walls must be penetrated here before harmful material may reach the outside from the working inner chamber. If the inner wall is damaged, contaminants are captured in the external wall which receives the internal wall.

The internal wall is received in the external wall in such a way that an intermediate chamber, which may be placed under partial vacuum, is enclosed between the two walls. At least one opening, which is connected to means for generating a partial vacuum, is provided in at least one of the walls. Except for the at least one opening for applying the partial vacuum, the internal and external walls thus form a closed structure. The intermediate chamber is, except for the at least one opening, completely enclosed by the internal and external walls. If the means for generating the partial vacuum is put into operation, a partial vacuum thus forms in the intermediate chamber. If contaminants nonetheless reach the intermediate chamber as a result of damage to the floor trough, their exit from the intermediate chamber into the surroundings of the workbench is at least made more difficult and typically entirely prevented. The contaminants may be withdrawn from the intermediate chamber by the means for generating the partial vacuum and fed to a purification device, which removes the contaminants from the withdrawn air.

The means for generating the partial vacuum are not especially restricted in principle. For example, they may be a pump or a fan. It is advantageous to use partial vacuum generation means which are already present in any case in the area of the safety workbench as the partial vacuum generation means. For example, the intermediate chamber of the floor trough may be attached via the at least one opening to an exhaust air system, which removes and filters the room air at the installation location. If desired, a filter may also be interposed between the opening of the floor trough and the exhaust air system. It is especially advantageous to use a fan already present in the safety workbench as the means for generating the partial vacuum.

Typically an exhaust air fan, which conveys air via a filter to the outside from the safety workbench, and, in addition, in safety workbenches of class II, a circulation air fan, which circulates the air inside the safety workbench to generate the so-called down flow in which air is blown in the working inner chamber from top to bottom in the direction toward the work surface and cross-contamination (contamination from one processed sample to another) is thus prevented, are provided as fans in safety workbenches. The air conveyed by the fans out of the working inner chamber is typically first withdrawn through openings in the work surface and into a rear area of the safety workbench via the surface, facing toward the working inner chamber, of the floor trough situated below the work surface. The air is conducted there through a channel which is formed behind a rear wall, which terminates the working inner chamber to the rear, opposite the work opening. The channel runs from bottom to top in the direction toward the fan typically situated above the working inner chamber.

This configuration suggests itself and is preferred according to the present invention if the at least one opening of the floor trough to which the partial vacuum is applied is connected to one of the areas of the ventilation system of the safety workbench impinged by partial vacuum, in particular using the channel behind the working inner chamber described above. Therefore, the at least one opening of the floor trough is preferably also situated in its rear area—i.e., facing away from the housing front side. The position of the opening is not fundamentally restricted further, however, and it may be provided both in the internal wall and also in the external wall. Because of the better accessibility, however, the at least one opening is typically preferably provided in the external wall. An intake connecting part may be provided over the opening for easier connection.

The shape, size, number, and attachment location of the opening are expediently selected in such a way that a sufficient partial vacuum is achieved in the intermediate chamber, which expediently extends into all areas of the intermediate chamber. With a large floor trough, a spatial distribution of the openings over the area of the floor trough may be advisable. Otherwise, the cited properties are not subject to any special restriction.

The floor trough itself may—except for the double-walled implementation and the attachment of the at least one opening to achieve a partial vacuum in the intermediate chamber—be implemented in a typical way. It is advisable to implement the floor of at least the internal wall as inclined, so that the liquid collected in the floor trough runs down to a lowest point. An outlet may be situated there in a way known per se, through which the collected liquid may be drained out of the floor trough. The outlet is expediently led downward through the internal and external walls in such a way that there is no opening in the floor trough to the intermediate chamber which endangers the implementation of the partial vacuum. A pipe is preferably led through the internal and external walls, whose external circumference the internal and external walls adjoin tightly. The pipe may be closed at its bottom end using a cock, a valve, or in a similar way.

The implementation of the floor trough according to the present invention reliably prevents contaminants from unintentionally escaping to the outside in this area and contaminating the surroundings of the safety workbench. Even if the wall of the floor trough is damaged, the double-walled implementation and the application of a partial vacuum to the intermediate chamber prevent disadvantages to user and surroundings. It is especially advantageous that means according to the present invention may be provided to establish damage of the floor trough. For this purpose, for example, measurement means may be provided, which measure the partial vacuum in the intermediate chamber. These measurement means may comprise any typical pressure meter and may be a barometric cell, which is either situated in the intermediate chamber itself or in proximity to one of the partial vacuum openings of the floor trough. If one of the walls of the floor trough is damaged, the pressure rises in the intermediate chamber. This is established by the measurement means. A comparative value may be stored in a safety monitoring device, as is typically provided in a safety workbench, which fixes a specific pressure in the intermediate chamber as a setpoint value. If a comparison unit in the safety monitoring device establishes a deviation from this setpoint value, an alarm signaling device is caused to output a visual and/or acoustic alarm. The visual alarm may not only be output by a blinking light or a similar device, but rather a corresponding warning message may also be output on a display which is also typically provided in any case, which notifies of damage to the floor trough, so that it may be repaired. Instead of a punctual comparison value, a comparison value range may also be stored to permit certain harmless pressure oscillations in the intermediate chamber.

BRIEF DESCRIPTION OF THE DRAWINGS

The present invention is explained in greater detail in the following for exemplary purposes on the basis of drawings. Only one preferred exemplary embodiment is described, to which the present invention is not restricted, however.

DETAILED DESCRIPTION

Figure 1:
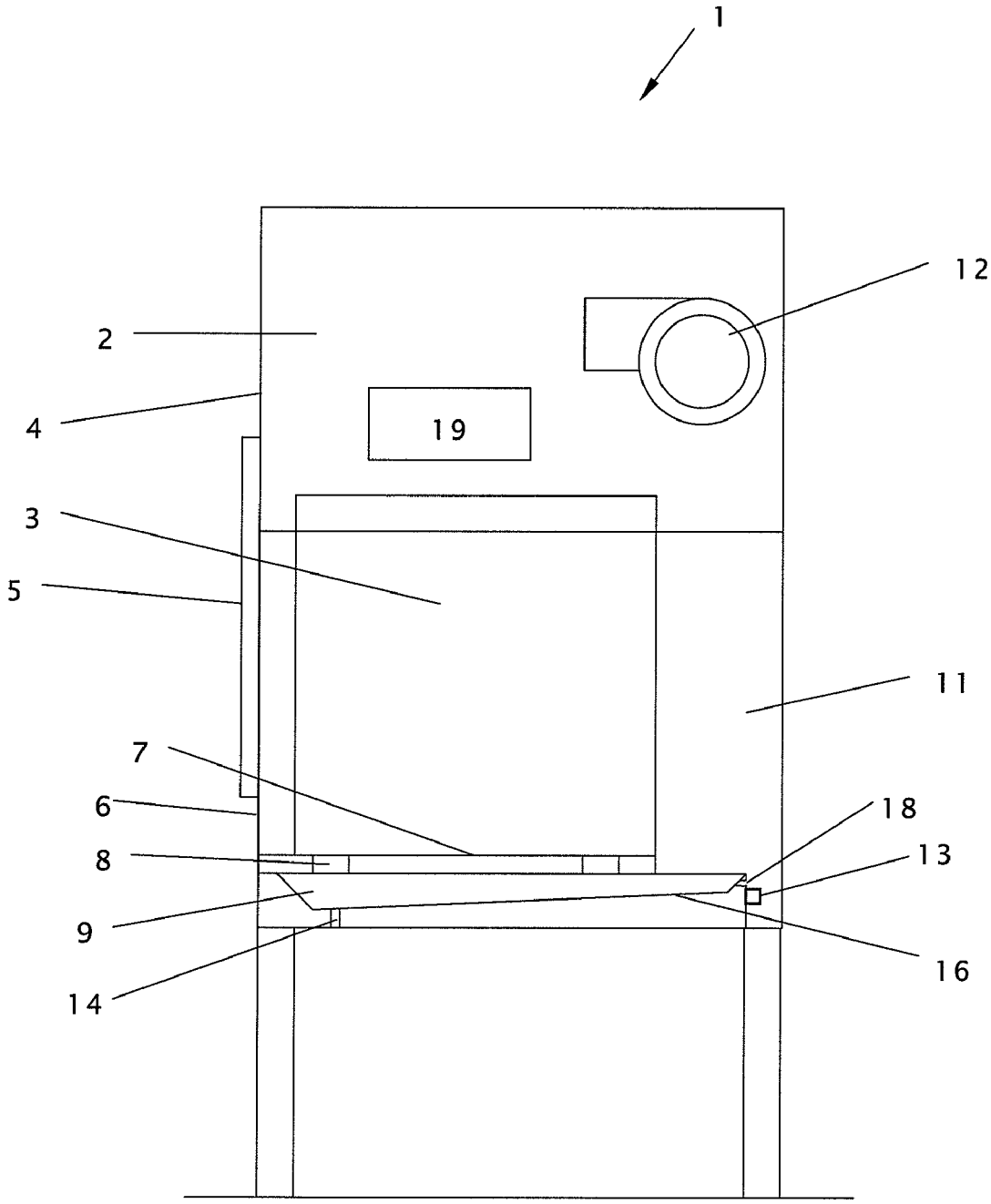
FIG. 1 schematically shows a safety workbench according to the present invention having a floor trough in a side view.
Figure 2:
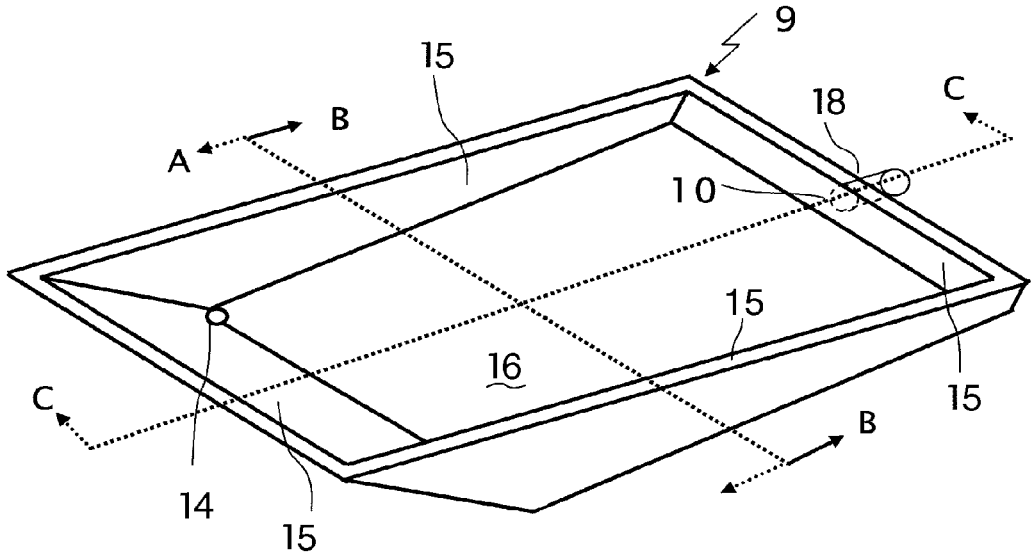
FIG. 2 schematically shows the floor trough from FIG. 1 in a perspective illustration.
Figure 3:
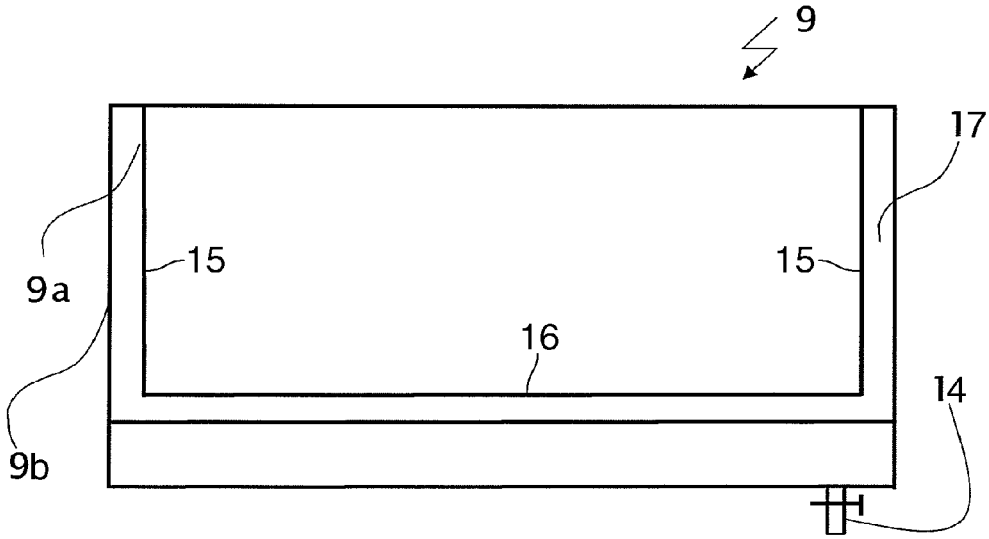
FIG. 3 schematically shows a view of the floor trough from FIG. 1 in a cross-section A-A.
Figure 4:
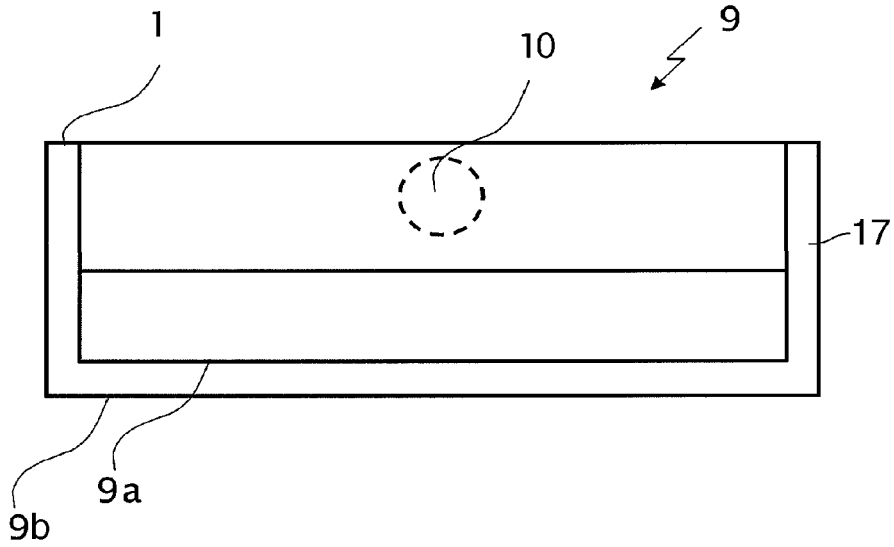
FIG. 4 schematically shows a view of the floor trough from FIG. 1 in a cross-section B-B.
Figure 5:
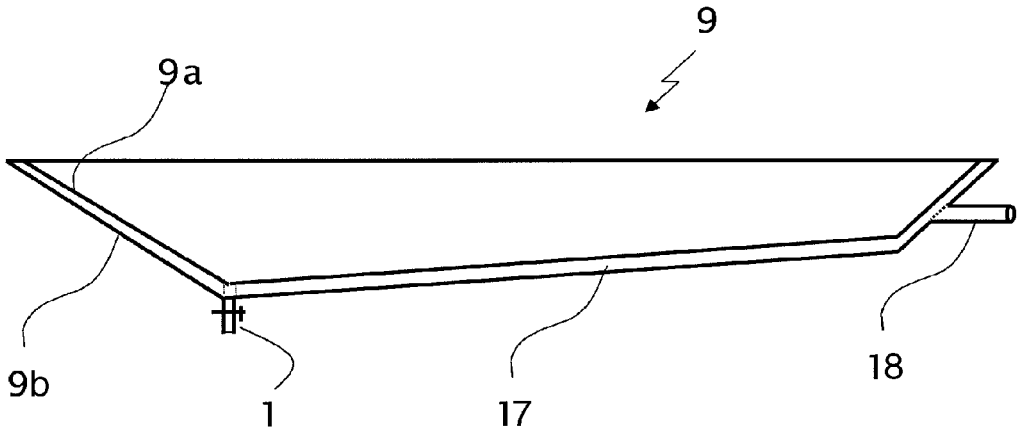
FIG. 5 schematically shows a view of the floor trough from FIG. 1 in a longitudinal section C-C.

FIG. 1 shows a safety workbench 1, as may be used for microbiological work, for example. The working inner chamber 3 of the safety workbench 1 is enclosed by a housing 2. A front pane 5 is attached to the housing front side 4 of the safety workbench 1, which may be adjusted in such a way that work may be performed on samples in the working inner chamber 3. The samples may be placed on a work level 7, which is provided with air slots 8. Contaminated air is withdrawn from the working inner chamber 3 through air slots 8, led further below the work level 7 to the rear in the direction of a channel 11, which runs from bottom to top and is separated from the working inner chamber, and finally suctioned in by the fan 12. Before leaving the safety workbench 1, the contaminated air is conducted over a filter (not shown here) to remove the contaminants. The air leaving the safety workbench is replaced by ambient air, which enters through the work opening 6. The entering air flow prevents contaminants from exiting.

A floor trough 9 is situated below the work level 7 in such a way that it terminates the working inner chamber 3 from below in relation to the surroundings of the safety workbench 1. Damage to the floor trough 9 harbors the danger that contaminants will reach the surroundings of the safety workbench directly. To reduce this danger, the floor trough 9 is implemented as double-walled according to the present invention. This may be inferred from FIGS. 2 through 5. The double-walled floor trough 9 comprises an inner wall 9*a*, which is inserted into a larger external wall 9*b*. Both walls are permanently connected to one another around their circumference on their upper edges and form a completely closed structure, except for one opening 10. An intermediate chamber 17, which extends practically over the entire area of the floor trough, is formed between the walls.

The opening 10, which provides the only access to the intermediate chamber 17, is located in a rear area of the external wall 9*b* facing away from the housing front side 4. An intake connecting part 18 is connected to the external wall via the opening 10. This intake connecting part 18 opens into the channel 11 of the ventilation system of the safety workbench 1. If the fan 12 is operated, a partial vacuum arises in the intermediate chamber 17 due to the air flow from bottom to top in the channel 11 and thus away from the opening 10. If, because of damage to the internal wall 9*a*, material from the working inner chamber 3 passes via the openings 8 in the work level 7 and through the wall 9*a*, the material does not immediately exit unobstructed into the surroundings of the safety workbench 1. Rather, it is captured in the external wall 9*b*, withdrawn from there out of the intermediate chamber 17 and fed to the filtration devices of the safety workbench. There is only a serious danger that the surroundings of the safety workbench will be contaminated when both walls 9*a* and 9*b* are penetrated. The danger is also reduced here, however, because a partial vacuum still exists in the intermediate chamber 17 and contaminants may thus not exit completely unobstructed.

To be able to notice damage to the floor trough 9 or other faults of the partial vacuum in the intermediate chamber 17, the partial vacuum is expediently monitored. For this purpose, the partial vacuum is measured using a pressure meter such as a barometric cell 13, which is situated directly at the outlet of the intake connecting part 18 here. The pressure measured values, which may be measured continuously or at predefined intervals, are transmitted to a safety monitoring system 19, as is typically provided in safety workbenches. The pressure measured value is compared there to a comparison value or comparison value range, which defines the permissible pressure or pressure range in the intermediate chamber. If the measured value deviates from the comparison value or comparison value range—for example, because the pressure has risen as a result of damage to the floor trough—the safety monitoring system outputs a visual and/or acoustic alarm. For example, a notification may be output on a display that the pressure in the floor trough is too high and the floor trough has to be checked.

The shape of the floor trough also largely corresponds to shapes typical up to this point for floor troughs of safety workbenches. The internal wall 9*a* has a rectangular floor plate 16 here and side walls 15 projecting vertically above this plate or inclined outward. The floor plate 16 is inclined downward and to the left toward the housing front side 4. The opening for an outlet 14 is thus located at the lowest point of the internal wall 9*a*. The shape of the external wall 9*b* corresponds to that of the wall 9*a*, but is enlarged in relation thereto. The outlet 14 is formed by a cylindrical pipe which penetrates the internal and external walls 9*a*, 9*b* and projects downward on the bottom side of the wall 9*b*. The pipe is closable using a cock. It opens into a capture system for disposing of contaminated waste, for example. In order that the partial vacuum in the intermediate chamber 17 is not canceled out, the external and internal walls are attached tightly to the external circumference of the pipe.

The floor trough may also be produced in a typical way from all materials used up to this point for this purpose, with the proviso that they are suitable for producing the double-walled structure. The floor trough preferably comprises metal, especially corrosion-resistant metal such as stainless steel in particular. The floor and side walls may be manufactured from individual parts or by bending from larger sheets. The joints of the edges and corners of the floor trough sheets are bonded to one another by a soldering, welding, or laser method, for example.

What is claimed is:

1. A safety workbench having a working inner chamber enclosed by a housing, the working inner chamber having a bottom terminus formed by a floor trough and the working inner chamber being accessible on a housing front side via a work opening, the work opening being closable by an adjustable front pane, wherein the floor trough is double-walled and has an internal wall and an external wall enclosing an intermediate chamber which is placed under partial vacuum, each of the internal wall and the external wall having an inclined floor plate and a plurality of side walls extending upwardly from the floor plate, and at least one of the internal and external walls has at least one opening which is operatively connected to means for generating the partial vacuum.

2. The safety workbench according to claim 1, wherein the means for generating the partial vacuum is a fan of the safety workbench.

3. The safety workbench according to claim 1, wherein the at least one opening is situated in the external wall of the floor trough.

4. The safety workbench according to claim 1, wherein the at least one opening is attached to the side of the floor trough facing away from the housing front side.

5. The safety workbench according to claim 1, wherein an intake connecting part is attached to the at least one opening of the floor trough.

6. The safety workbench according to claim 1, wherein the floor trough has at least one outlet for draining liquid collected on the internal wall, the outlet penetrating the internal and external walls in such a way that the intermediate chamber is not open to the outside.

7. The safety workbench according to claim 1, wherein measurement means operatively coupled to the intermediate chamber are provided for determining a partial vacuum in the intermediate chamber.

8. The safety workbench according to claim 7, wherein a safety monitoring device is provided which compares a pressure measured value ascertained by the measurement means to a stored comparison value or comparison value range and triggers at least one of a visual or acoustic alarm in the event of a deviation of the pressure measured value ascertained by the measurement means and the stored comparison value or comparison value range.

* * * * *